US008984991B1

(12) United States Patent
English

(10) Patent No.: US 8,984,991 B1
(45) Date of Patent: Mar. 24, 2015

(54) FASTENER REMOVAL DEVICE FOR DIRTY ENVIRONMENTS

(71) Applicant: Brad A. English, Tucson, AZ (US)

(72) Inventor: Brad A. English, Tucson, AZ (US)

( * ) Notice: Subject to any disclaimer, the term of this patent is extended or adjusted under 35 U.S.C. 154(b) by 1 day.

(21) Appl. No.: 14/259,717

(22) Filed: Apr. 23, 2014

Related U.S. Application Data

(60) Provisional application No. 61/814,935, filed on Apr. 23, 2013.

(51) Int. Cl.

| | |
|---|---|
| ***B25B 13/50*** | (2006.01) |
| ***B25B 23/00*** | (2006.01) |
| ***B25B 13/06*** | (2006.01) |
| ***B25B 13/48*** | (2006.01) |

(52) U.S. Cl.
CPC ..... *B25B 13/06* (2013.01); *B25B 13/481* (2013.01)
USPC ..... 81/121.1; 81/53.2

(58) Field of Classification Search
USPC ..... 81/121.1, 124.2, 184; 408/239 R, 230
See application file for complete search history.

(56) References Cited

U.S. PATENT DOCUMENTS

| | | | | |
|---|---|---|---|---|
| 4,970,922 | A * | 11/1990 | Krivec | 81/460 |
| 5,019,080 | A * | 5/1991 | Hemer | 606/104 |
| 5,291,811 | A * | 3/1994 | Goss | 81/460 |
| 5,957,645 | A * | 9/1999 | Stacy | 411/404 |
| 6,047,620 | A * | 4/2000 | Kozak et al. | 81/441 |
| 6,158,310 | A * | 12/2000 | Goss et al. | 81/121.1 |
| 7,225,710 | B2 * | 6/2007 | Pacheco, Jr. | 81/460 |
| 7,594,455 | B2 * | 9/2009 | Swanson et al. | 81/53.2 |
| 8,166,851 | B2 * | 5/2012 | Pchola et al. | 81/460 |
| 8,607,670 | B2 * | 12/2013 | Stawarski | 81/53.2 |
| 8,607,672 | B2 * | 12/2013 | Urick et al. | 81/121.1 |
| 2006/0266168 | A1 * | 11/2006 | Pacheco, Jr. | 81/460 |
| 2006/0278049 | A1 * | 12/2006 | Baynham | 81/436 |
| 2009/0028654 | A1 * | 1/2009 | Turrini | 408/1 R |
| 2010/0124466 | A1 * | 5/2010 | Men | 408/144 |

* cited by examiner

*Primary Examiner* — Hadi Shakeri
*Assistant Examiner* — Danny Hong

(57) ABSTRACT

A fastener removal device for accessing and securing a fastener head while in a dirty environment features a cylindrical nut driver. A driver first end features a nut driver head having a hexagonal recess centrally located on a nut driver first end surface. A bottom surface of the hexagonal recess is located on a hexagonal recess plane. The hexagonal recess plane is located parallel to and offset from the nut driver first end surface. The hexagonal recess is adapted to engage with a head of a fastener. A plurality of helical flutes is located around a driver first end outer periphery. A flute first end intersects the nut driver first end surface. A flute second end intersects the hexagonal recess plane. The driver second end features a hexagonal shank adapted to engage a drill chuck of a drill.

9 Claims, 5 Drawing Sheets

FASTENER REMOVAL DEVICE FOR DIRTY ENVIRONMENTS

CROSS REFERENCE

This application claims priority to U.S. Patent Application No. 61/814,935, filed Apr. 23, 2013, the specification(s) of which is/are incorporated herein in their entirety by reference.

FIELD OF THE INVENTION

The present invention relates to fastener removal devices, or more specifically, fastener removal devices used in drill chucks.

BACKGROUND OF THE INVENTION

Fasteners have been used as a means to connect two or more items together for centuries. In current times, a popular method of removing fasteners is using a nut driver in a drill chuck. In dirty environment, however, the recess for engaging the fastener can become plugged with debris when attempting to engage the fastener or there may be too much debris surrounding the fastener for effective removal. The present invention features a fastener removal device for accessing and securing a fastener head while in a dirty environment.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a fastener removal device for accessing and securing a fastener head while in a dirty environment. In some embodiments, the device comprises a cylindrical nut driver. In some embodiments, a driver first end comprises a nut driver head. In some embodiments, the nut driver head comprises a hexagonal recess centrally located on a nut driver first end surface thereon. In some embodiments, a bottom surface of the hexagonal recess is located on a hexagonal recess plane. In some embodiments, the hexagonal recess plane is located parallel to and offset from the nut driver first end surface. In some embodiments, the hexagonal recess is adapted to engage with a head of a fastener. In some embodiments, a plurality of flutes is located around a driver first end outer periphery. In some embodiments, a flute first end intersects the nut driver first end surface. In some embodiments, a flute second end intersects the hexagonal recess plane. In some embodiments, the plurality of flutes is helical. In some embodiments, the driver second end comprises a hexagonal shank located thereon. In some embodiments, the hexagonal shank is adapted to engage a drill chuck of a drill.

DESCRIPTION OF PREFERRED EMBODIMENTS

Figure 1:
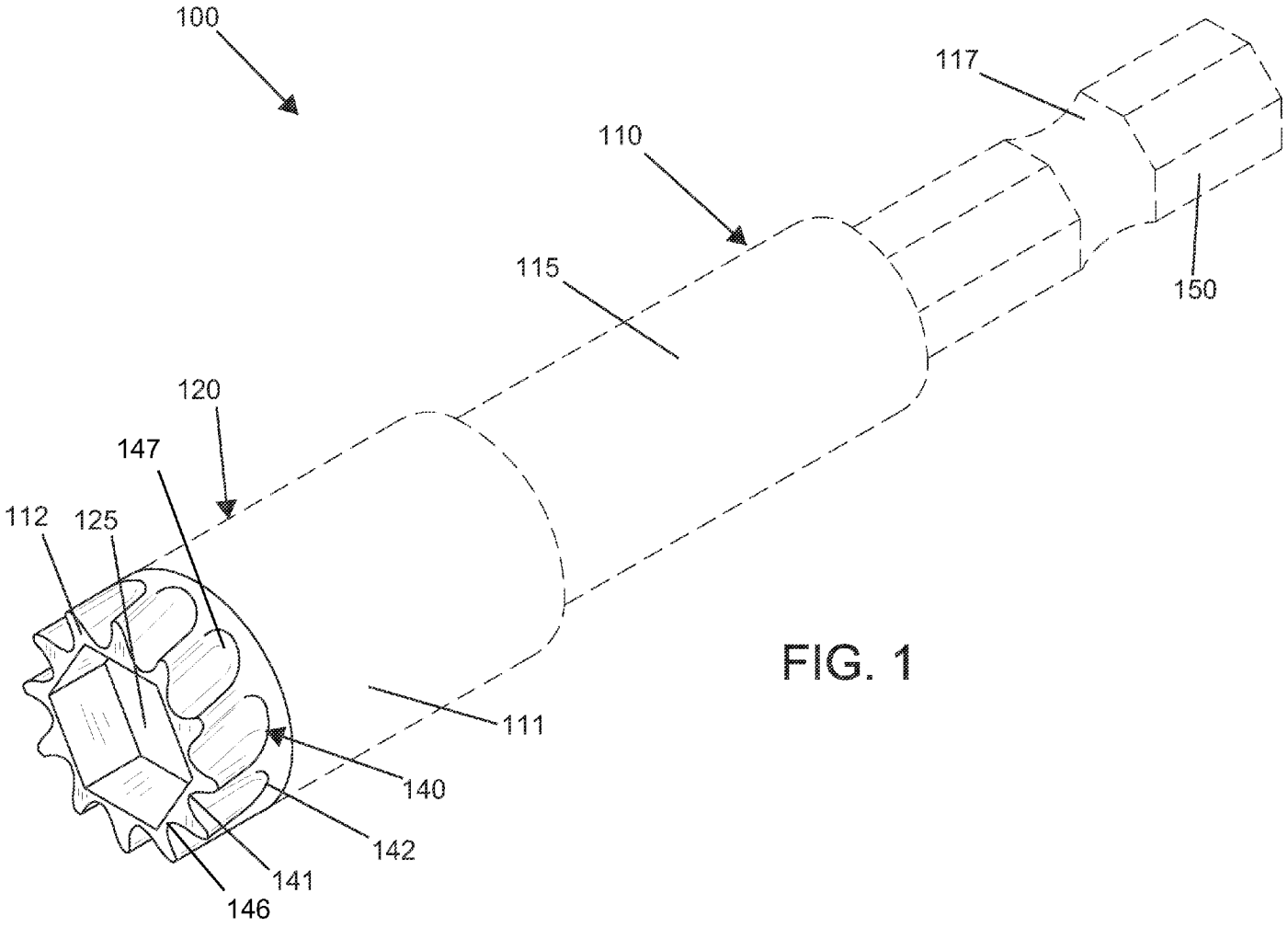
FIG. 1 shows a perspective view of the present invention.
Figure 3:
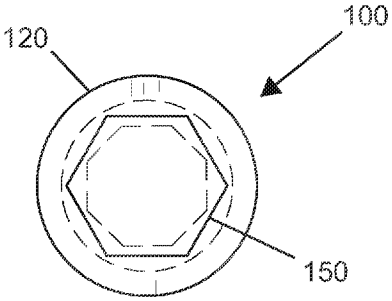
FIG. 3 shows a rear view of the present invention.
Figure 2:
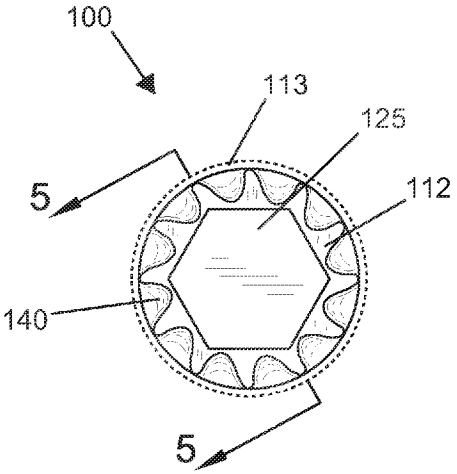
FIG. 2 shows a front view of the present invention.
Figure 4A:
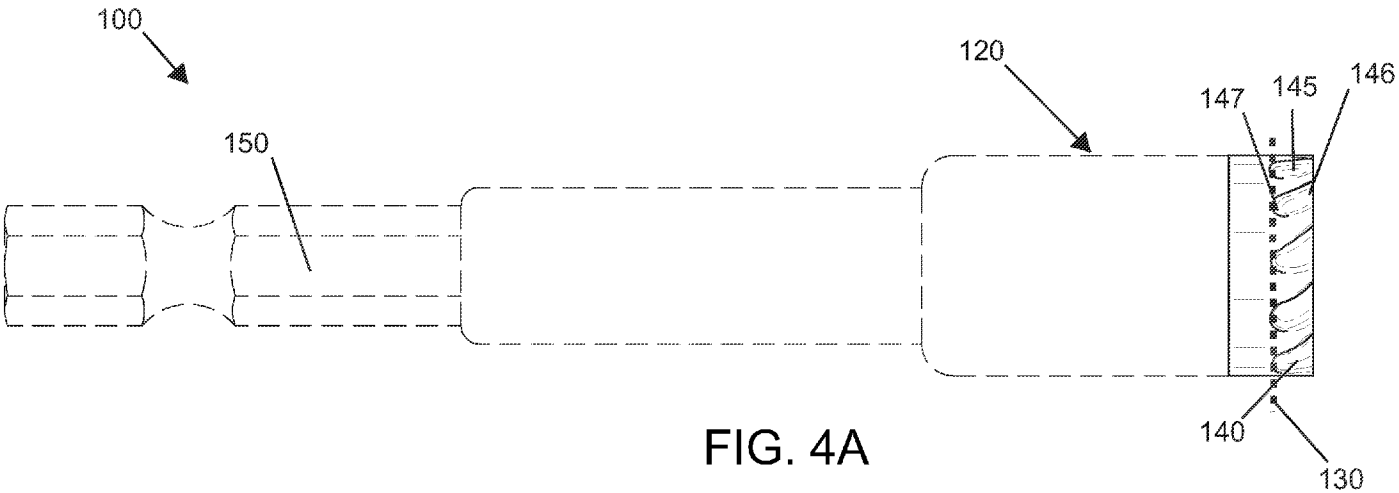
FIG. 4A shows a side view of the present invention.
Figure 4B:
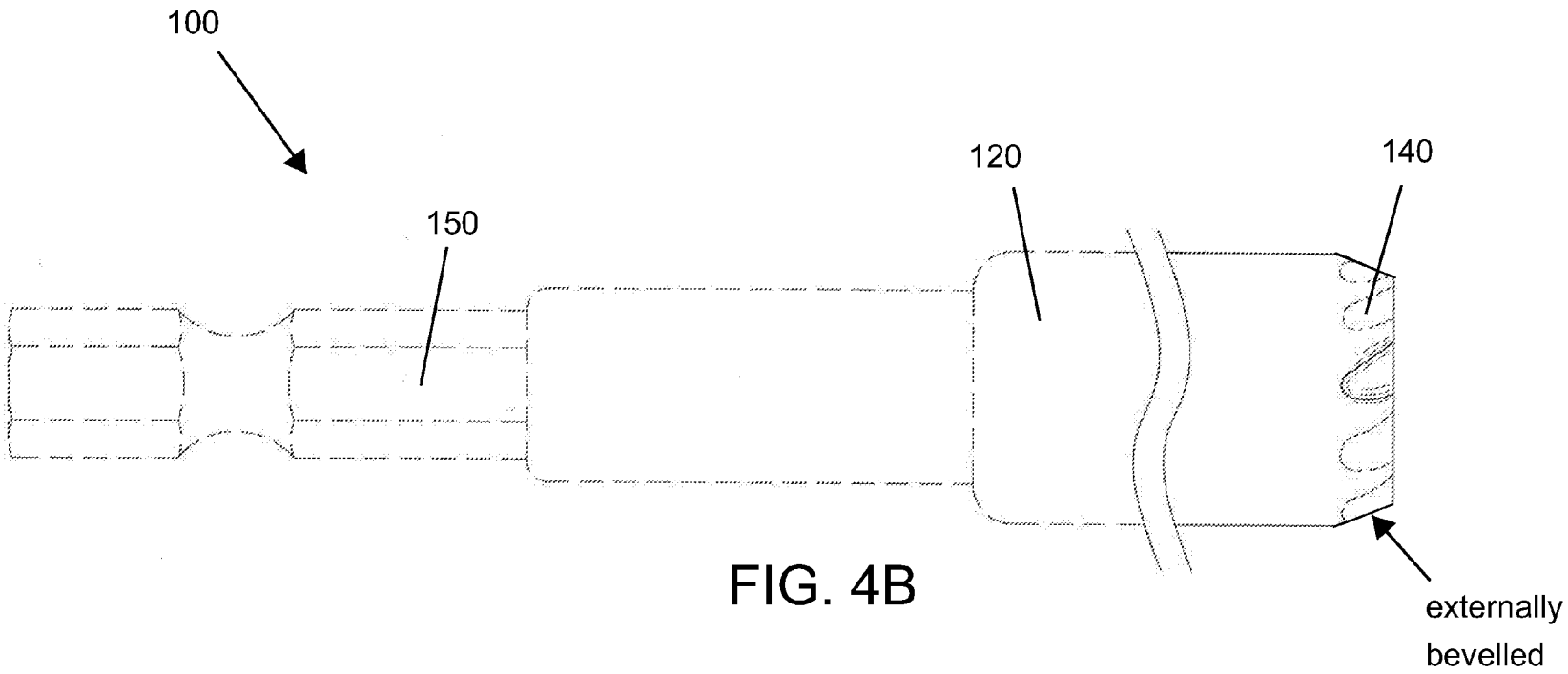
FIG. 4B shows a side view of an alternate embodiment of the present invention.
Figure 4C:
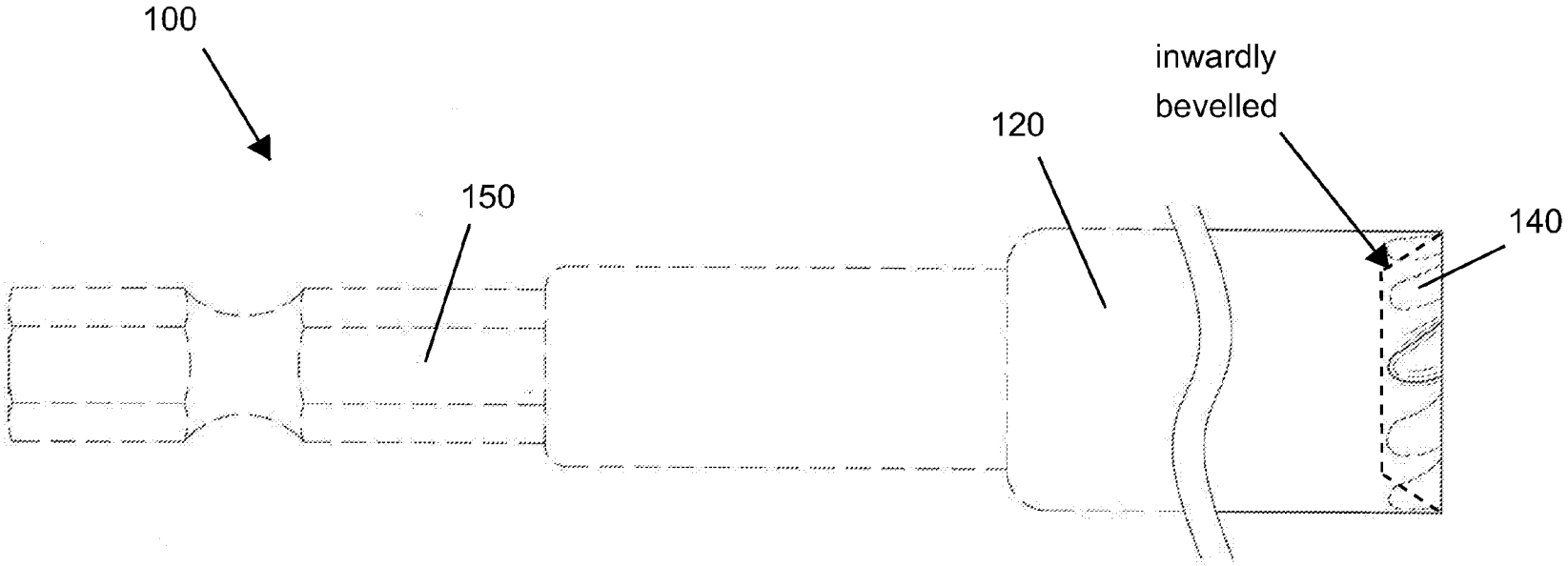
FIG. 4C shows a side view of an alternate embodiment of the present invention.
Figure 5:
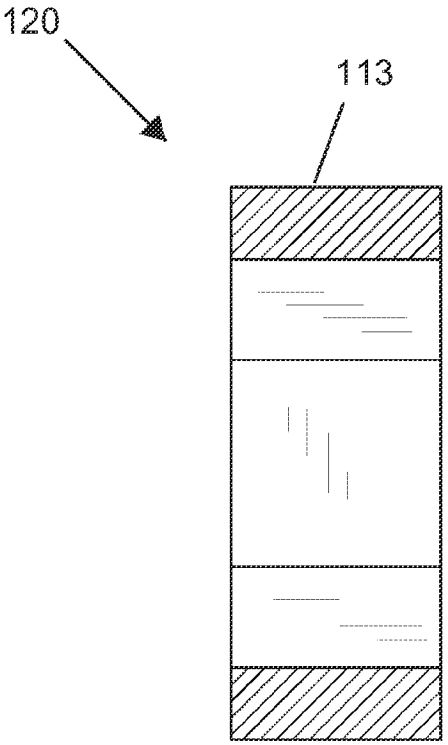
FIG. 5 shows a cross sectional view of the present invention.

Following is a list of elements corresponding to a particular element referred to herein:

100 Fastener removal device
110 Nut driver
111 Driver first end
112 Driver first end surface
113 Driver first end outer periphery
115 Driver mid-section
117 Driver second end
120 Nut driver head
125 Recess
130 Recess plane
140 Flute
141 Flute first end
142 Flute second end
145 Flute depth
146 Flute first end depth
147 Flute second end depth
150 Hexagonal shank Referring now to FIG. 1-5, the present invention features a fastener removal device (100) for accessing and securing a fastener head while in a dirty environment. In some embodiments, the device (100) comprises a cylindrical nut driver (110) having a driver first end (111), a driver mid-section (115) and a driver second end (117). In some embodiments, the driver first end (111), the driver mid-section (115) and the driver second end (117) each comprise a unique diameter. In some embodiments, each diameter is staggered and offset from the others, decreasing from the driver first end (111) to the driver second end (117).

In some embodiments, the driver first end (111) comprises a diameter between ⅛" and ¼". In some embodiments, the driver first end (111) comprises a diameter between ¼" and ½". In some embodiments, the driver first end (111) comprises a diameter between ½" and ¾". In some embodiments, the driver first end (111) comprises a diameter between ¾" and 1". In some embodiments, the driver first end (111) comprises a diameter greater than 1".

In some embodiments, the driver mid-section (115) comprises a diameter between ⅛" and ¼". In some embodiments, the driver mid-section (115) comprises a diameter between ¼" and ½". In some embodiments, the driver mid-section (115) comprises a diameter between ½" and ¾". In some embodiments, the driver mid-section (115) comprises a diameter greater than ¾". In some embodiments, the driver mid-section (115) comprises a smaller diameter than the driver first end (111).

In some embodiments, the driver second end (117) comprises a diameter between ⅛" and ¼". In some embodiments, the driver second end (117) comprises a diameter between ¼" and ½". In some embodiments, the driver second end (117) comprises a diameter greater than ½". In some embodiments, the driver second end (117) comprises a smaller diameter than the driver mid-section (115).

In some embodiments, the length of the fastener removal device (100) from the driver first end (111) to the driver second end (117) is 1" or less. In some embodiments, the length of the fastener removal device (100) from the driver first end (111) to the driver second end (117) is between 1"

and 1.5". In some embodiments, the length of the fastener removal device (100) from the driver first end (111) to the driver second end (117) is between 1.5" and 2". In some embodiments, the length of the fastener removal device (100) from the driver first end (111) to the driver second end (117) is between 2" and 3". In some embodiments, the length of the fastener removal device (100) from the driver first end (111) to the driver second end (117) is greater than 3".

In some embodiments, the driver first end (111) comprises a nut driver head (120) located thereon. In some embodiments, the nut driver head (120) comprises a hexagonal recess (125) centrally located on a driver first end surface (112) thereon. In some embodiments, a bottom floor of the hexagonal recess (125) is located on a hexagonal recess plane (130). In some embodiments, the hexagonal recess plane (130) is located parallel to and offset from the driver first end surface (112). In some embodiments, the hexagonal recess (125) is adapted to engage with a head of a fastener.

In some embodiments, the recess (125) is not hexagonal. In some embodiments, the recess (125) is a shape adapted to fittably engage with a head of a fastener. In some embodiments, the head of the fastener may be square, rectangular, polygonal or irregular with a corresponding oppositely shaped recess (125).

In some embodiments, a plurality of flutes (140) is located around a driver first end outer periphery (113). In some embodiments, a flute first end (141) intersects the driver first end surface (112). In some embodiments, a flute second end (142) intersects the hexagonal recess plane (130). In some embodiments, the plurality of flutes (140) is helical.

In some embodiments, each of the plurality of flutes (140) is disposed at an angle. In some embodiments, the angle is 90 degrees from the driver first end surface (112). In some embodiments, the angle is 75 degrees from the driver first end surface (112). In some embodiments, the angle is 60 degrees from the driver first end surface (112). In some embodiments, the angle is 45 degrees from the driver first end surface (112). In some embodiments, the angle is 30 degrees from the driver first end surface (112). In some embodiments, the angle is 15 degrees from the driver first end surface (112).

In some embodiments, the flute (140) comprises a flute first end depth (146) greater than a flute second end depth (147). In some embodiments, the flute depth (145) decreases as it approaches the hexagonal recess plane (130).

In some embodiments, the flute depth (145) is measured from an outer diameter of the nut driver head (120) at a point to an inner most surface of the flute (140) at the same point.

In some embodiments, a flute length from the flute first end (141) to the flute second end (142) is less than 1/16". In some embodiments, a flute length from the flute first end (141) to the flute second end (142) is between 1/16" and 1/8" In some embodiments, a flute length from the flute first end (141) to the flute second end (142) is between 1/8" and 1/4". In some embodiments, a flute length from the flute first end (141) to the flute second end (142) is between 1/4" and 1/2". In some embodiments, a flute length from the flute first end (141) to the flute second end (142) is greater than 1/2". In some embodiments, a flute length of one flute (140) is identical to a flute length of all other flutes (140). In some embodiments, a flute length of one flute (140) is different that a flute length of all other flutes (140), for example, each flute length may be varied per design considerations. In some embodiments, a first portion of flute lengths may be equal and a second portion of flute lengths may be equal. In some embodiments, the first portion of flute lengths may not equal the second portion of flute lengths.

In some embodiments, the flute second end (142) does not intersect the hexagonal recess plane (130). In some embodiments, the flute second end (142) extends past the hexagonal recess plane (130).

In some embodiments, the plurality of flutes (140) is adapted to accept debris from around the fastener head when the hexagonal recess (125) is placed on the fastener head. In some embodiments, the plurality of flutes (140) is adapted to accept debris from around the fastener head when the drill is operated in reverse. In some embodiments, by accepting debris from around the fastener head, the fastener head is able to interface with the hexagonal recess (125) without obstruction from the debris.

In some embodiments, the flute (140) is a channel fluidly connecting the driver first end (111) to a backside of the nut driver head (120). In some embodiments, the flute (140) channels and propels debris from the driver first end (111) to the backside of the nut driver head (120). In some embodiments, the flute (140) removes debris from the area in front of the nut driver head (120) and channels and propels debris to the backside of the nut driver head (120).

In some embodiments, the driver first end (111) is beveled on a driver first end outer periphery (113). In some embodiments, the bevel is a 30 degree angle. In some embodiments, the bevel is a 45 degree angle. In some embodiments, the bevel is a 60 degree angle.

In some embodiments, the driver first end (111) is beveled on a driver first end inner periphery. In some embodiments, the bevel is a 30 degree angle. In some embodiments, the bevel is a 45 degree angle. In some embodiments, the bevel is a 60 degree angle.

In some embodiments, the driver first end (111) tapers to a blunt end. In some embodiments, the driver first end (111) tapers to a sharp edge.

In some embodiments, the driver second end (117) comprises a hexagonal shank (150) located thereon. In some embodiments, the hexagonal shank (150) is adapted to engage a drill chuck of a drill.

In some embodiments, the plurality of flutes (140) comprises three flutes (140). In some embodiments, the plurality of flutes (140) comprises four flutes (140). In some embodiments, the plurality of flutes (140) comprises six flutes (140). In some embodiments, the plurality of flutes (140) comprises nine flutes (140). In some embodiments, the plurality of flutes (140) comprises twelve flutes (140). In some embodiments, the plurality of flutes (140) comprises more than twelve flutes (140).

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A fastener removal device (100) for accessing and securing a fastener head while in a dirty environment, wherein the device (100) comprises a nut driver (110) having a driver first end (111) and a driver second end (117), wherein the driver first end (111) comprises a nut driver head (120) disposed thereon, wherein the nut driver head (120) comprises a recess (125) centrally disposed on a driver first end surface (112) thereon, wherein the recess (125) is adapted to engage with a head of a fastener, wherein a plurality of flutes (140) is disposed around a driver first end outer periphery (113), wherein the plurality of flutes (140) is helical, wherein the flute (140) comprises a flute first end depth (146) greater than a flute second end depth (147), such that a sloping floor exists from the flute second end depth (147) to the flute first end depth (146), wherein the floor centrally slopes from the recess plane (130) to the driver first end (111), wherein the flute depth (145) decreases as it approaches the hexagonal recess plane (130), wherein the driver second end (117) comprises a shank (150) disposed thereon, wherein the shank (150) is adapted to engage a drill chuck of a drill.

2. A fastener removal device (100) for accessing and securing a fastener head while in a dirty environment, wherein the device (100) comprises a cylindrical nut driver (110) having a driver first end (111), a driver mid-section (115) and a driver second end (117), wherein the driver first end (111) comprises a nut driver head (120) disposed thereon, wherein the nut driver head (120) comprises a hexagonal recess (125) centrally disposed on a driver first end surface (112) thereon, wherein the hexagonal recess (125) is disposed on a hexagonal recess plane (130), wherein the hexagonal recess plane (130) is disposed parallel to and offset from the driver first end surface (112), wherein the hexagonal recess (125) is adapted to engage with a head of a fastener, wherein a plurality of flutes (140) is disposed around a driver first end outer periphery (113), wherein a flute first end (141) intersects the driver first end surface (112), wherein a flute second end (142) intersects the hexagonal recess plane (130), wherein the plurality of flutes (140) is helical, wherein the flute (140) comprises a flute first end depth (146) greater than a flute second end depth (147), such that a sloping floor exists from the flute second end depth (147) to the flute first end depth (146), wherein the floor centrally slopes from the recess plane (130) to the driver first end (111), wherein the flute depth (145) decreases as it approaches the hexagonal recess plane (130), wherein the driver second end (117) comprises a hexagonal shank (150) disposed thereon, wherein the hexagonal shank (150) is adapted to engage a drill chuck of a drill.

3. The device (100) of claim 2, wherein the plurality of flutes (140) comprises three flutes (140).

4. The device (100) of claim 2, wherein the plurality of flutes (140) comprises four flutes (140).

5. The device (100) of claim 2, wherein the plurality of flutes (140) comprises six flutes (140).

6. The device (100) of claim 2, wherein the plurality of flutes (140) comprises nine flutes (140).

7. The device (100) of claim 2, wherein the plurality of flutes (140) comprises twelve flutes (140).

8. The device (100) of claim 2, wherein the plurality of flutes (140) comprises more than twelve flutes (140).

9. A fastener removal device (100) for accessing and securing a fastener head while in a dirty environment, wherein the device (100) consists of a nut driver (110) having a driver first end (111) and a driver second end (117), wherein the driver first end (111) consists of a nut driver head (120) disposed thereon, wherein the nut driver head (120) consists of a recess (125) centrally disposed on a driver first end surface (112) thereon, wherein the recess (125) is adapted to engage with a head of a fastener, wherein a plurality of flutes (140) is disposed around a driver first end outer periphery (113), wherein the plurality of flutes (140) is helical, wherein the flute (140) consists of a flute first end depth (146) greater than a flute second end depth (147), such that a sloping floor exists from the flute second end depth (147) to the flute first end depth (146), wherein the floor centrally slopes from the recess plane (130) to the driver first end (111), wherein the flute depth (145) decreases as it approaches the hexagonal recess plane (130), wherein the driver second end (117) consists of a shank (150) disposed thereon, wherein the shank (150) is adapted to engage a drill chuck of a drill.

* * * * *